US008695307B2

(12) United States Patent
Bissery et al.

(10) Patent No.: US 8,695,307 B2
(45) Date of Patent: Apr. 15, 2014

(54) DOUBLE-LUG FASTENER FOR SECURING A RIDGE OR HIP STRIP

(75) Inventors: Christophe Bissery, Saint-Germain en Laye (FR); Frédéric Marcon, Brétigny sur Orge (FR)

(73) Assignee: Umicore, Brussels (BE)

( * ) Notice: Subject to any disclaimer, the term of this patent is extended or adjusted under 35 U.S.C. 154(b) by 38 days.

(21) Appl. No.: 13/055,339

(22) PCT Filed: Jul. 16, 2009

(86) PCT No.: PCT/EP2009/005163

§ 371 (c)(1), (2), (4) Date: Feb. 28, 2011

(87) PCT Pub. No.: WO2010/012384

PCT Pub. Date: Feb. 4, 2010

(65) Prior Publication Data

US 2011/0162316 A1 Jul. 7, 2011

(30) Foreign Application Priority Data

Jul. 30, 2008 (EP) ..... 08013656

(51) Int. Cl.
*E04D 13/147* (2006.01)

(52) U.S. Cl.
USPC ..... 52/713; 52/43; 52/44; 52/466; 248/237

(58) Field of Classification Search
USPC ..... 52/698, 713, 489.1, 287.1, 288.1, 198, 52/199, 43, 44, 543, 545, 547, 478, 466; 248/213, 237, 211, 215, 324, 304, 308, 248/294.1, 301; 454/364, 365, 355; 24/370, 24/372, 376, 457
See application file for complete search history.

(56) References Cited

U.S. PATENT DOCUMENTS 240,729 A * 4/1881 Jones ..... 52/546
318,352 A * 5/1885 Caldwell ..... 52/466

(Continued)

FOREIGN PATENT DOCUMENTS

AU 4426079 8/1980
DE 1292359 4/1969

(Continued)

OTHER PUBLICATIONS

International Search Report, issued in PCT/EP2009/005163, dated Sep. 14, 2009.

*Primary Examiner* — Robert Canfield
*Assistant Examiner* — Babajide Demuren
(74) *Attorney, Agent, or Firm* — Brinks Gilson & Lione

(57) ABSTRACT

The invention falls within the field of the securing of protective strips covering the ridge or hip regions of a metal roof with standing seams. More specifically, the invention relates to a double tab metal fastener for securing a ridge strap or hip strap on a metal roof covering of the type with a standing seam, comprising:—a first tab (1) forming at one of its ends a hook (2) intended to be secured to the standing seam;—a second tab (3) forming at one of its ends a hook (4) intended to accept an edge of the ridge or hip strap; the two tabs being articulated about an axis (5) allowing their respective rotation in a plane intended to lie substantially parallel to the plane of the roof. This double tab represents a retaining system that can be used for ridging and hipping, which is easy to fit, without any through-fasteners, thus guaranteeing perfect sealing.

2 Claims, 4 Drawing Sheets

(56) References Cited

U.S. PATENT DOCUMENTS

Figure 1:
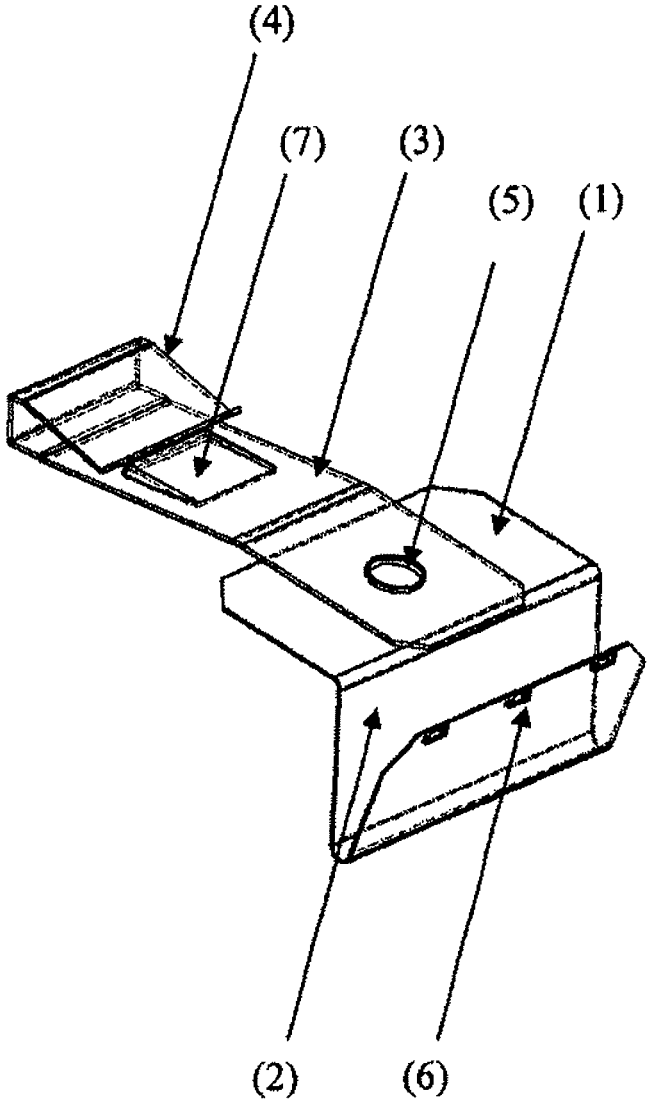

| | | | | | |
|---|---|---|---|---|---|
| 361,007 | A | * | 4/1887 | Gould | 24/370 |
| 734,777 | A | * | 7/1903 | Utley | 24/370 |
| 763,014 | A | * | 6/1904 | Neider | 24/457 |
| 792,553 | A | * | 6/1905 | Porter | 24/372 |
| 1,152,118 | A | * | 8/1915 | Nickol | 248/237 |
| 1,152,685 | A | * | 9/1915 | Winn | 248/237 |
| 1,187,369 | A | * | 6/1916 | Neville | 248/237 |
| 1,607,045 | A | * | 11/1926 | Bernhard | 248/215 |
| 1,894,895 | A | * | 1/1933 | Beevor et al. | 248/72 |
| 1,946,757 | A | * | 2/1934 | Parker | 248/237 |
| 2,092,411 | A | * | 9/1937 | August | 52/223.6 |
| 2,272,642 | A | * | 2/1942 | Owen | 182/206 |
| 2,286,539 | A | * | 6/1942 | Hagerstrom | 248/201 |
| 3,103,047 | A | * | 9/1963 | Wolf, Jr. | 24/376 |
| 3,292,336 | A | * | 12/1966 | Brynjolfsson et al. | 52/713 |
| 3,381,426 | A | | 5/1968 | Heidrich | |
| 4,535,962 | A | * | 8/1985 | Chan et al. | 248/214 |
| RE33,563 | E | * | 4/1991 | Heckelsberg | 52/404.2 |
| 5,282,597 | A | * | 2/1994 | Babcock | 248/237 |
| 5,287,944 | A | * | 2/1994 | Woodyard | 182/3 |
| 5,412,843 | A | * | 5/1995 | Krongauz et al. | 16/387 |
| 5,893,253 | A | * | 4/1999 | Lutz, III | 52/695 |
| 6,050,035 | A | * | 4/2000 | Thompson et al. | 52/167.1 |
| 7,216,466 | B2 | * | 5/2007 | Nystrom | 52/712 |
| 7,766,285 | B2 | * | 8/2010 | Cox et al. | 248/74.2 |
| 2003/0145548 | A1 | * | 8/2003 | Mitchell | 52/536 |
| 2006/0096233 | A1 | | 5/2006 | Nystrom | |
| 2008/0250742 | A1 | * | 10/2008 | Smola et al. | 52/543 |

FOREIGN PATENT DOCUMENTS

| | | | | |
|---|---|---|---|---|
| DE | 4307982 | | 9/1994 | |
| DE | 202008003478 | | 5/2008 | |
| GB | 2255125 | A * | 10/1992 | E04G 21/28 |

* cited by examiner

DOUBLE-LUG FASTENER FOR SECURING A RIDGE OR HIP STRIP

This application is a National Stage application of International Application No. PCT/EP2009/005163, filed Jul. 16, 2009, the entire contents of which is hereby incorporated herein by reference. This application also claims priority under 35 U.S.C. §119 to European Patent Application No. 08013656.7, filed Jul. 30, 2008, the entire contents of which is hereby incorporated herein by reference.

The invention falls within the field of the attachment of protective strips that cover the ridge or hip regions of a standing seam metal roof.

The traditional solutions are effective but very elaborate. They require specialist and expensive know how. Mention may, by way of example, be made of the production of pinched seams which require a cutting template associated with the use of top clips, or alternatively the method that involves laying the standing seams over and then turning them up against a batten that then has to be covered by a protective strip known as a "cap".

Simplified solutions based on the use of Z sections, usually metal, which serve to hold the protective strip in place also exist, but their main disadvantage stems from the need for a fastening that passes through the roofing. This fastening generally consists of a self-tapping screw with a sealed washer to which an additional sealing gasket is added. Installation is therefore permanent and cannot be adjusted. The Z sections have to be orientated precisely and this orientation is defined at the time of placement, generally using a mason's line. This is done in order to ensure that the Z section is properly seated to engage with the edge of the protective strip for a clenching effect.

The subject of the present invention is a retaining system that can be used on ridges and hips, that is easy to affix and which avoids the use of a through-fastening. FIG. 1 illustrates the invention.

More specifically, the invention relates to a double-lug metal fastener for securing a ridge or hip strip to a metal roof covering of the standing seam type, comprising:

a first lug (1) which at one of its ends forms a hook (2) intended to be secured to the standing seam;

a second lug (3) which at one of its ends forms a hook (4) intended to accept one edge of the ridge or hip strip; the two lugs being articulated about an axis (5) that allows their respective rotation in a plane intended to lie substantially parallel with the plane of the roofing.

The fastener is preferably provided, on its hook (2) that is intended to be secured to the standing seam, with embossings (6). This device enhances the immobility of the lug in the standing seam. The embossings, the depths of which may vary, allow the lug both to be inserted in the standing seam and to be immobilized through a progressive clamping effect. Thus, the fitting of the lug is easier and its immobilization is optimized.

The fastener may advantageously be provided, on its hook (4) that is intended to accommodate one edge of the ridge or hip strip, with retaining means (7) for clipping onto a fold of said edge.

The pivoting connection between the two lugs of the fastening may advantageously be achieved by dimpling, that is to say with no added mechanical fastener.

Stainless steel appears to be an ideal choice from which to manufacture the fastening lug because this material offers good compatibility with the zinc-based alloy typically used for roof coverings, and guarantees an adequate durability.

The subject of the invention also extends to metal roof coverings of the standing seam type, equipped with a ridge or hip strip fastened using lugs like those defined hereinabove, when these are secured to the standing seams using non-piercing means.

In one particularly advantageous embodiment, the hooks (2) are secured to the standing seams 10 by insertion into the vertical fall 12, that is to say the one perpendicular to the plane of the roofing, of the fold via which said standing seams are crimped together. This insertion, from the bottom up, is preferably performed forcibly, that is by slightly deforming the standing seam that has already been formed.

Finally, the invention relates to the use of the lugs as defined hereinabove for fastening a ridge or hip strip to a metal roof covering of the standing seam type using non-piercing means.

It is beneficial to provide the hooks (2) with a width of 50 to 100 mm, this dimension providing sufficient immobilization. Immobilization can be further enhanced by the embossings like those defined hereinabove. The depth of these embossings may range between 0.1 and 3 mm. When producing the double lug from stainless steel sheet, thicknesses ranging from 0.3 to 1.5 mm will preferably be chosen.

The system offers sufficient mechanical strength against the loadings transmitted by the structure. Immobilization is effective in the case of forces normal to the roofing and forces of sliding along the axis of the standing seam.

Note that the orientation of the standing seam defines that of said first lug, this lug being inserted in the vertical fold of the standing seam. Now, the angle between, on the one hand, the edges of the protective strip and, on the other hand, the standing seams, is dependent on the geometry of the roof. It is therefore necessary to allow the two lugs that make up the double lug to rotate. This is especially relevant when protecting a hip. Entirely free rotation, which therefore means rotation over 360°, would be particularly advantageous. This rotation guarantees that the hook that engages with the edge of the protective strip is firmly seated irrespective of the orientation of the standing seam in relation to this edge.

The new fastener is anchored to the roofing by being blocked immobile in position, that is to say using simple non-piercing means that guarantee a perfect seal. Unlike other systems for attachment to standing seams, there is absolutely no need here to use nuts and bolts. Once secured to the roofing, the fastener can simply, by rotation, be adapted to suit all customary geometries. Adjustment during affixing operations is easy. The fastener can be removed without damaging the roofing.

The following figures illustrate the invention and the prior art.

FIG. 1: Double lug according to the invention.

Figure 2A:
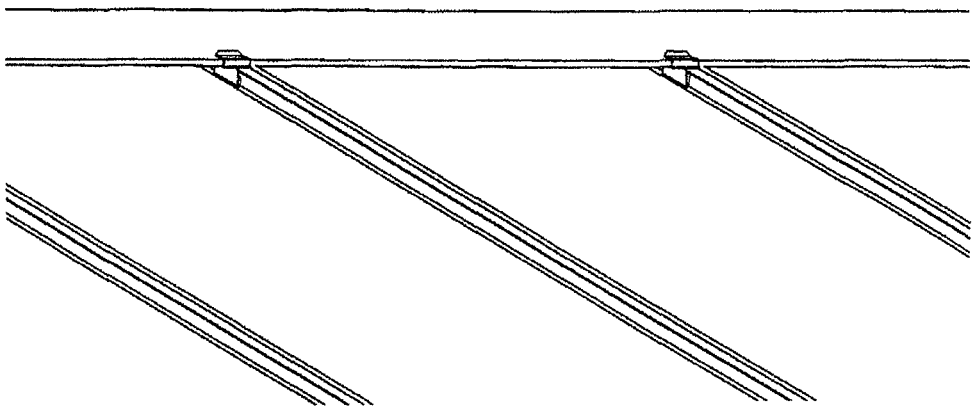
Figure 2B:
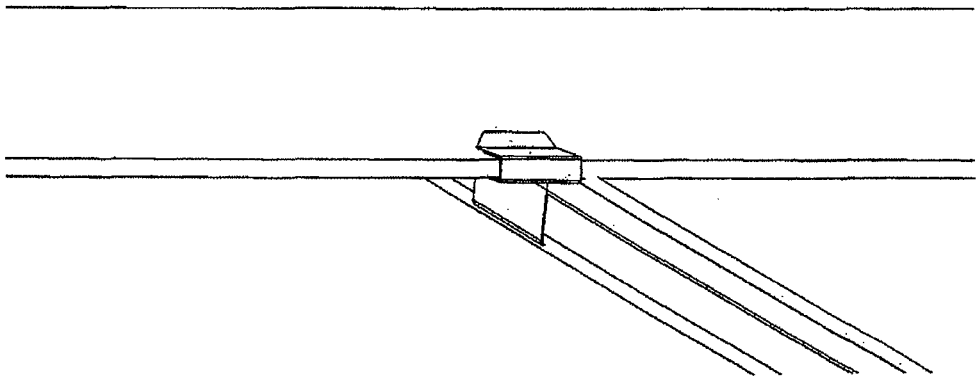

FIG. 2: Use of the retaining system according to the invention on a ridge (general arrangement 2*a*; detail 2*b*).

Figure 3:
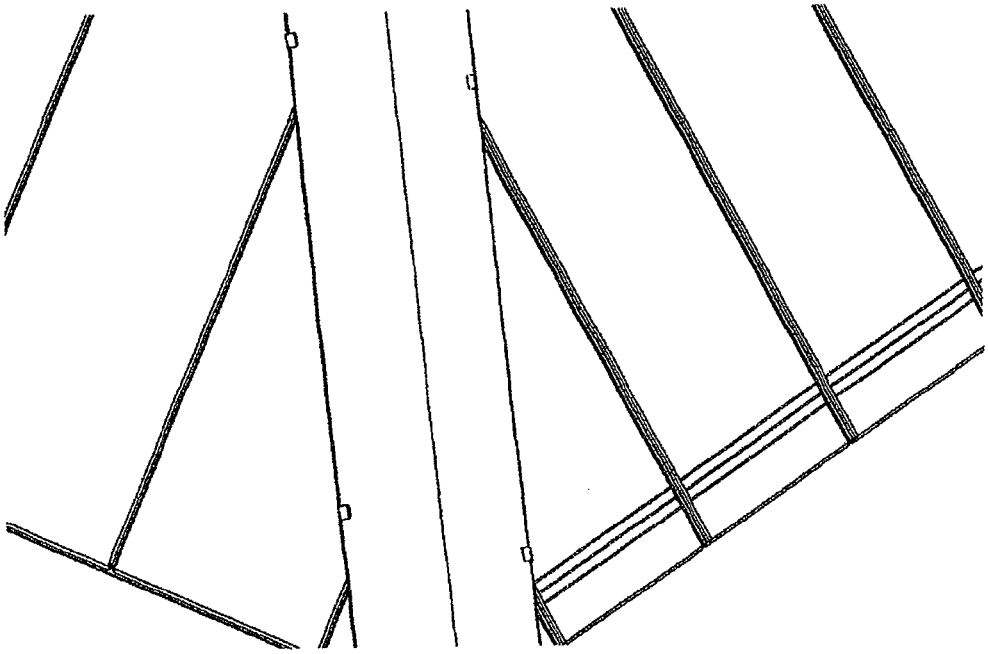

FIG. 3: Use of the retaining system according to the invention on a hip (plan view)

Figure 4:
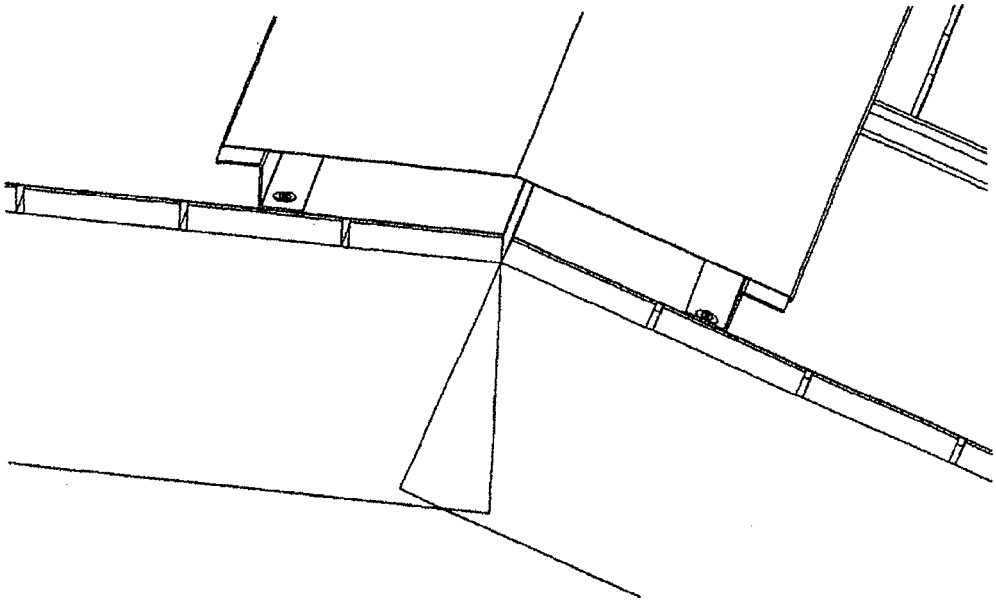

FIG. 4: Use of Z sections according to the prior art, with through-fasteners (perspective view).

Figure 5:
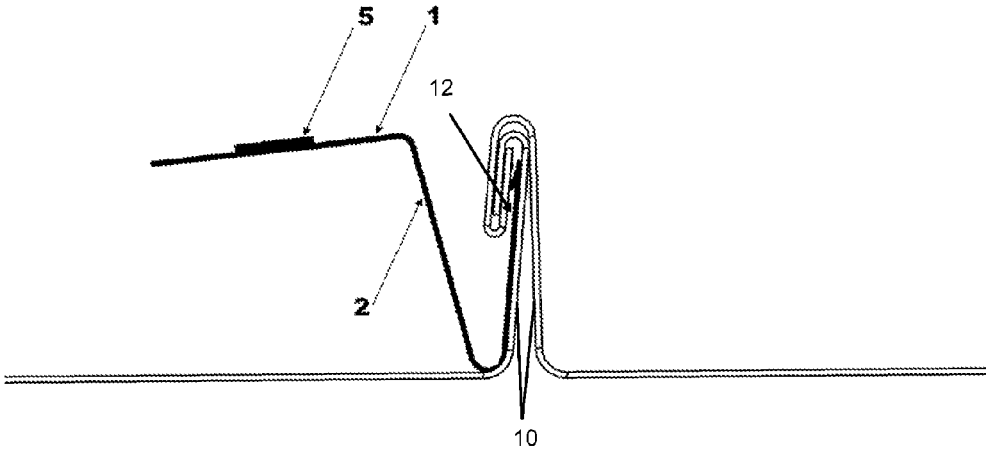

FIG. 5: Use of the double lug according to the invention on a standing seam of a standing seam metal roof (side view).

EXAMPLE OF USE ON A RIDGE

Upon fitting, the double lug is positioned at a distance from the ridge that corresponds to the width of the protective strip. The double lug is forcibly inserted under the standing seam profile by striking it horizontally and laterally using a hammer or a mallet. It may be beneficial to use a block of wood slipped under the vertical part of the hook (2) to make it easier to strike. The same procedure is followed on each standing seam profile along the ridge. The end of the protective strip is then clipped into several hooks (4) at a time, to provide connection with the roofing. The double lugs can be shifted slightly by sliding them along each standing seam so as to make it easier to insert the protective strip. The edge of the protective strip, which forms a fold, engages with the hooks (4) so as to engage effectively by clip fastening and improve the subsequent immobilization.

EXAMPLE OF USE ON A HIP

The double lug is installed as described hereinabove by forcible insertion under the standing seam profile at a distance from the axis of the hip that corresponds to the width of the protective strip. The hook (4) is positioned by rotating it about the axis of assembly of the two hooks, so as to permit connection with the protective strip. The same procedure is followed for each standing seam profile along the hip. The end of the protective strip is then clipped into several hooks (4) at a time to connect with the roofing. Like with use on a ridge, the double lugs can be shifted slightly by sliding them along each standing seam to make it easier to insert the protective strip. Here again, the edge of the protective strip, which forms a fold, engages with the hooks (4) so as to engage effectively by clip-fastening and improve the subsequent immobilization.

The invention claimed is:

1. A metal roof covering of the standing seam type, equipped with a ridge or hip strip fastened using a double-lug metal fastener, the fastener comprising a first lug which at one of its ends forms a first hook configured to be secured to the standing seam by non-piercing means; and a second lug which at one of its ends forms a second hook configured to accept one edge of the ridge or hip strip; the two lugs being constructed of metal sheet material and articulated about an axis that allows their respective rotation in a plane intended to lie substantially parallel with a plane of a roofing when the two lugs are attached to the roofing, wherein the first hooks of the fastener are secured to the standing seams of the metal roof covering using non-piercing means.

2. The metal roof covering of claim 1, wherein the first hooks are secured to the standing seams by insertion into vertical falls of folds of the standing seams whereby said standing seams are crimped together.

* * * * *

UNITED STATES PATENT AND TRADEMARK OFFICE

CERTIFICATE OF CORRECTION

PATENT NO. : 8,695,307 B2
APPLICATION NO. : 13/055339
DATED : April 15, 2014
INVENTOR(S) : Bissery et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 67 days.

Signed and Sealed this
Twenty-ninth Day of September, 2015

Michelle K. Lee

Michelle K. Lee
*Director of the United States Patent and Trademark Office*